United States Patent [19]

Wright

[11] 4,269,580

[45] May 26, 1981

[54] COMPRESSION MOLDING PRESS WITH HYDRAULIC CONTROLS

[75] Inventor: Dolph D. Wright, Union Lake, Mich.

[73] Assignee: General Motors Corporation, Detroit, Mich.

[21] Appl. No.: 158,476

[22] Filed: Jun. 11, 1980

[51] Int. Cl.[3] ..... B30B 15/16

[52] U.S. Cl. ..... 425/150; 425/406

[58] Field of Search ..... 425/149, 150, 406, 411

[56] References Cited

U.S. PATENT DOCUMENTS

| | | | |
|---|---|---|---|
| 3,719,445 | 3/1973 | Sindelar | 425/150 |
| 3,881,852 | 5/1975 | Ahrweiler | 425/150 X |
| 3,901,635 | 8/1975 | Greenberger | 425/150 X |
| 3,994,648 | 11/1976 | Kornylak et al. | 425/150 |
| 4,076,780 | 2/1978 | Ditto . | |
| 4,157,066 | 6/1979 | Pretty . | |

*Primary Examiner*—J. Howard Flint, Jr.
*Attorney, Agent, or Firm*—Warren D. Hill

[57] ABSTRACT

Predominately hydraulic controls with an optional electrical feedback loop for a compression molding press is provided for a press having the main force provided by four hydraulic cylinders one at each corner of the ram and a fifth cylinder at its center. A hydromechanical servo valve at each corner of the press each in conjunction with a position gauge rod controls the adjacent cylinder to keep the ram parallel with the bed and an averaging valve applies the average pressure of the corner cylinders to the central cylinder. A servo controlled position motor synchronously moves each of the hydromechanical valves with respect to the ram to affect position and velocity control of the ram. A force comparator samples the average cylinder pressure to establish a maximum pressure and to override the position control when that maximum pressure is approached. The electrical control senses the position of the servo controller to compare press position to a preset program and to control the servo accordingly.

4 Claims, 2 Drawing Figures

COMPRESSION MOLDING PRESS WITH HYDRAULIC CONTROLS

Figure 1:
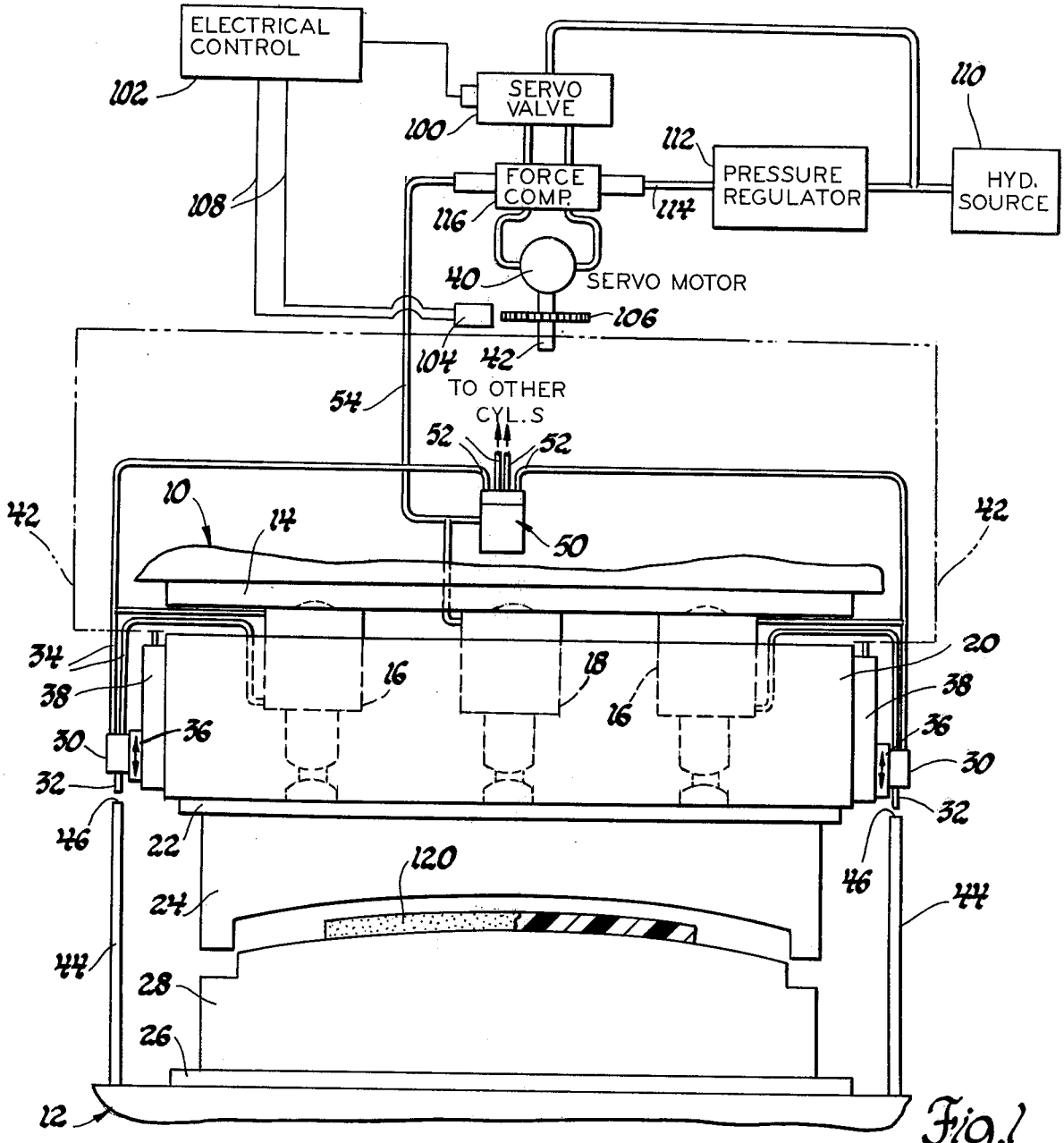

This invention relates to a hydraulically controlled compression molding press and in particular to such a press having position, velocity and force controls carried out by a hydraulic control system.

In compression molding large parts it is important to control the position of the upper mold half with respect to the lower mold half to obtain the proper flow of molding compound during press closing and in particular to control the parallelism between the molds as well as to control the maximum force during the final stages of the molding operation. The U.S. Pat. No. to Ditto 4,076,780 entitled "Programmable Velocity and Force Control Method for Compression Molding" set forth the method of such press control by controlling the force applied at each of the four corners of a press ram and to electrically sense the ram position at each corner of the press to control the forces through a control system which is primarily electrical. It is desirable at least in some applications to use control systems which are wholly or at least primarily hydraulic in order to make the system as rugged as possible for in-plant usage.

It is therefore an object of this invention to provide a hydraulic compression molding press having hydraulic controls for maintaining full parallelism and controlling the velocity and position of the molds during mold closure. It is a further object to provide such a press having a force limit control.

The invention is carried out by providing a press having an individual hydraulic cylinder at each corner of the press ram and a hydromechanical servo valve at each corner of the ram cooperating with a reference surface to control the pressure in the adjacent cylinder for establishing parallelism between the ram and bed, and a control for synchronously changing the relative positions of the servo valves and the reference surfaces to control the cylinders to move the ram according to a preset schedule. The invention is further carried out by providing an averaging valve for sampling the pressures of the four corner hydraulic cylinders and applying the average pressure to a fifth centrally located cylinder acting on the ram and further to compare the average pressure with a preset bias to establish a force limit on the press and to override the press position control when the maximum force is approached.

Figure 2:
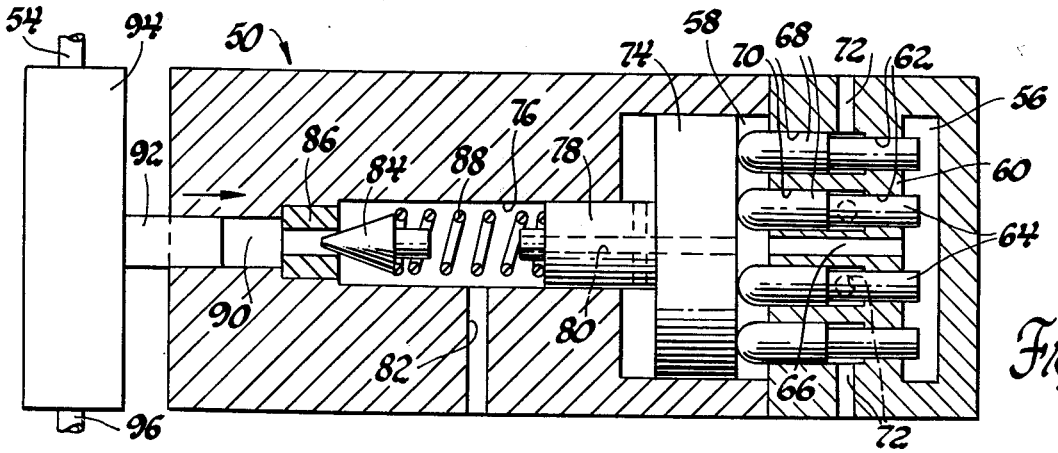

The above and other advantages will be made more apparent from the following specification taken in conjunction with the accompanying drawings wherein like reference numerals refer to like parts and wherein:

FIG. 1 is a schematic diagram of a compression molding press with a hydraulic control system according to the invention, and FIG. 2 is a schematic cross-sectional view of a pressure averaging control valve used in the control system of FIG. 1.

This invention deals with a hydraulic press having fine, accurate position control during its final stages of closing, that is, during the actual molding operation, and is not concerned with gross movements in mold opening or closing which is required for removal of the parts and introduction of new molding compound blanks. Many arrangements for the gross ram movement are well known and are not shown in the drawings. FIG. 1, however, shows a prepositioning ram 10 which can be moved toward the press bed 12 by a gross motion control, not shown, until the molds are 25 to 50 millimeters from closed position whereupon the ram 10 is clamped or locked in place. The prepositioning ram 10 supports an attachment base 14 which, in turn, supports four cylinders 16 one at each corner of the press and a fifth cylinder 18 located in the center of the press. The five cylinders, in turn, support a pressing ram 20. The ram 20 carries on its lower surface a mold heating plate 22 which supports an upper mold half 24. The press bed 12 likewise carries a mold heating plate 26 which supports on its upper surface a lower mold half 28.

A hydromechanical servo valve 30 having a downwardly extending cam follower 32 is mounted at each corner of the ram 20 or upper mold half 24 and is hydraulically connected by lines 34 to the cylinder 16 nearest the respective corner for controlling the hydraulic pressure within that cylinder. The servo valves 30 comprise, for example, MV6 mechanical servo valves manufactured by Hydraulic Controls Company, Newton, Mass. Each servo valve 30 is mounted on a slide 36 which, in turn, is mounted on and driven by an anti-backlash worm gear or ball screw drive 38 so that upon operation of the drive 38 the valve 30 can be moved vertically in either direction. A hydraulically driven position control servo motor 40 operates a high speed shaft drive 42 which synchronously operates all the ball screw drives 38 for synchronously moving the servo valves 30 in the vertical direction. Vertically aligned with each cam follower 32 is a stop member or position gauge rod 44 supported on the press bed or lower mold half which provides a cam surface 46 on its upper end for engagement with the cam follower 32. The cam follower 32 of the valve is biased outwardly toward the cam 46. The cam follower has an intermediate neutral position in which the valve effects no change in the pressure of its corresponding cylinder 16. When the cam follower 32 moves outwardly from that position, the cylinder pressure is caused to increase and when the cam follower is compressed the other direction from the neutral position, the cylinder pressure is decreased. Thus each servo valve 30 and its associated gauge rods 44 comprise the first and second parts of a position transducer. The servo valves each control the adjacent cylinder in the sense that when the cam follower is not in neutral position the cylinder pressure is changed to return the cam follower to neutral position. During initial setup the position gauge rods 44 are positioned relative to the servo valve 30 to uniformly contact the cam followers so that the ram 20 is parallel to the bed 12 when the cam followers 32 are all in neutral position. Then any imbalance of forces on the press which causes the ram 20 to become tilted would result in the gauge rods preferentially contacting the cam followers so that the cam follower 32 at the highest corner of the press is extended outwardly by the amount of the tilt so that the pressure in the corresponding cylinder will be increased to move that corner back into parallel whereas the opposite action occurs at the diagonal corner or lowest corner of the press to relieve the pressure on the cylinder there which also helps to return the pressure ram 20 to a position parallel with the bed 12.

By operation of the servo motor 40 and the high speed shaft drive 42 in the proper direction to move the servo valve 30 up with respect to the ram 20, the cam followers 32 will all be extended thereby increasing the pressure on the cylinder 16 and causing the ram 20 to move in a mold closing direction and to continue the motion until the new ram position causes the cam follower 32 to return to neutral position. Thus, the servo motor 40 controls the position and the velocity of the ram 20.

A pressure averaging valve 50 has four inlet lines 52 which are connected with the four pressure cylinders 16. The averaging valve produces an output on line 54 which is connected to the central cylinder 18. The pressure on line 54 is the average of the pressures in the corner cylinder 16. Thus, the central cylinder 18 contributes a proportionate share of the force to the ram 20 and by helping distribute the press force over the ram it minimizes deflection of the ram to thereby contribute to parallelism and accuracy of positioning.

FIG. 2 conceptually shows the pressure averaging valve 50. The valve comprises a housing having at one end a pair of cavities 56 and 58 separated by a web 60. The web includes four axial bores 62 each containing a differential area piston 64 which extends between the cavities 56 and 58. A passage 66 through the web equalizes the pressures in the two cavities. Each of the differential area pistons 64 has a large end 68 guided within an enlarged counterbore 70 of its respective bore 62. Each counterbore is connected to a port 72 which is coupled to one of the four lines 52 from the hydraulic cylinders 16 so that each of pistons 64 is urged toward the cavity 58 by a force proportional to its respective cylinder pressure. A piston 74 slidably disposed in the cavity 58 is contacted by the large ends 68 of the pistons 64. A small diameter bore 76 is axially aligned with and contiguous with the cavity 58. A guide shaft 78 on one end of the piston 74 slides within the bore 76. Passages 80 within the piston 74 and shaft 78 equalize the pressure in the bore 76 and both sides of the pistons 74 in the bore 58. A drain port 82 connects the bore 76 to exhaust. A poppet 84 within the bore 76 is urged against a seat 86 in the bore by a spring compression coil 88 which bears against the poppet and the hub 78. A port 90 which is normally closed by the poppet 84 connects the bore 76 to the pilot port 92 of a conventional pressure control valve 94. The latter valve has an exhaust port 96 connected to a drain and a control line 54 which carries a reduced pressure proportional to the pressure admitted to the pilot port 92. That latter pressure is determined by the poppet 84 which, in turn, is controlled by the combined forces on all the pistons 64 acting through the piston 74 and the spring 76. Thus, a high pressure is induced at the port 92 when the combined force on the pistons 64 is high so that the poppet 84 is urged strongly toward the seat 86. When, however, the pressure on the pistons 64 are low the pressure within the port 90 can push the poppet 84 from its seat allowing fluid to drain from the port 90 to the drain port 82 until a corresponding low pressure is reached in the port 90.

Referring again to FIG. 1, the position controlling servo motor 40 is, in turn, controlled by a solenoid operated velocity servo valve 100. That valve is governed by an electrical control 102 which is programmed to position the ram 20 according to a time schedule. The movement of the ram 20 is indirectly sensed by an electromagnetic pickup 104 which senses the teeth of a gear 106 that rotates with the high speed shaft drive 42. The pickup and gear comprise a digital shaft position transducer which, with the control 102, determines the ram position by counting the pulses induced in the transducer 104 during movement of the shaft drive 42. The transducer signal on line 108 is fed to the electrical control 102 as a feedback signal thereby closing the position control loop. Thus, the motor 40 is driven by a flow of hydraulic fluid from a hydraulic source 110 through the velocity servo valve 100 as metered by the programmed electrical control 102. Open loop controls can also be used in alternative embodiments. For example, a simple preset flow control could feed a constant flow of fluid to the motor 40 to afford a constant ram velocity. The open loop control could also comprise a cam profile flow control which would also vary the servo motor according to a preset schedule but without a position feedback.

A highly desirable feature in the hydraulic control circuit is a force limit control. A pressure control servo or regulator 112 connected to the pressure source 110 provides an adjustable preset bias or reference pressure on line 114 which is input to a force comparator 116. A second input of the force comparator is connected to the line 54 carrying the average pressure of the cylinders 16. The force comparator 116 is a four-way hydraulic piloted valve which is connected between the velocity servo valve 100 and the servo motor 40. The force comparator 116 has the ability to stop or reverse the servo motor 40 when a maximum force limit is approached regardless of the position or velocity input command from the servo valve 100. The force comparator 116 is biased by the preset pressure on line 114 to cause the position control servo motor 40 to drive forward whenever the servo valve 100 calls for forward movement. As the average pressure on line 54 rises toward the preset bias pressure on line 114, the fluid flow to the position control servo motor 40 will gradually decrease beginning at 95 percent of the preset pressure and will stop when the average pressure reaches the preset pressure, therefore, establishing a maximum force on the pressing ram 20.

In molding of resin materials forces are generated within the molding compound due to volumetric changes during chemical reactions. The force comparator 116 will sense any resulting overpressure condition and reverse the position servo motor to relieve the mold forces regardless of the position command. Further, if the electrical control 102 changes the direction command of the velocity servo valve 100, a mold can be opened to inject mold coating material or to strip the part from the mold. This is a position command and parallelism is maintained regardless of the opening force required.

It will thus be seen that in operation with the press opened a blank of sheet molding compound 120 is placed on the lower mold half 28 and then the prepositioning ram 10 is positioned by the gross positioning arrangement, not shown, and the ram 10 is locked into place with the mold half 24 located 25 to 50 millimeters above the ultimate finished part position. Then under control of the electrical control 102 the servo motor 40 drives the high speed shaft drive 42 to rotate the ball screw drive 38 at each corner of the press to move the hydromechanical servo valves 30 vertically thereby effecting increasing pressure in the cylinders 16 and 18 to advance the pressing ram 20 toward the bed 12. During this time the molding compound 120 is squeezed throughout all parts of the mold cavity and compressed into the desired final form, the velocity of spreading of that material being controlled by the program set in the controller 102. The maximum force to be applied to the molding compound is determined by the pressure control servo 112 acting on the force comparator 116. The mold, if desired, can be opened under the operation of the electrical control 102 for the injection on the mold surface of a coating material to improve the appearance of the molded part and the mold then reclosed to complete the curing of the finished part. Then still under control of the electrical control 102 the molds are opened to strip the part from the mold. Finally the ram 10 is raised by the gross positioning apparatus, not shown, to fully open the mold for removal of the part.

It will thus be seen that the apparatus according to this invention provides rugged hydraulic controls for precise control of a plastic molding press and that the precision of the press is enhanced by a plurality of individually controlled hydraulic cylinders to apply the pressing force, the cylinders being controlled by individual position sensitive servo valves as well as at least one central cylinder operated at the average pressure of the outer cylinders to minimize deflection of the pressing ram. It will further be seen that this apparatus as herein disclosed has the ability to accurately control the position and velocity of the pressing ram during the final stages of mold closing and all the while keeping the ram parallel to the press bed. In addition, the maximum force applied to the part is also controlled using hydraulic control components. Many variations within the ambit of the disclosure are apparent, for example, the positions of the gauge rods 44 and the hydromechanical servo valve 30 may be reversed with the valve 30 placed on the press bed or on the lower mold half. Further either of the two elements 44 or 30 may be movable under control of the servo motor 40.

The embodiments of the invention in which an exclusive property or privilege is claimed are defined as follows:

1. A hydraulic control for a compression molding press, the press having a bed, a ram, and a plurality of hydraulic cylinders positioned on the ram to provide the main press force for urging the ram toward the bed, including A plurality of position transducers each having a pair of separate parts mounted on supports respectively comprising the ram and the bed, the parts of each pair being aligned to contact each other upon press closing, means for movably mounting one part of each pair on its support for adjustment of its position relative to its complementing part, the parts of each pair consisting of a hydromechanical servo valve including a cam follower and a stop member including a cam surface for contacting the cam follower, the hydromechanical servo valves each hydraulically coupled with an adjacent one of said cylinders to control the cylinder pressure, the cam follower of each servo valve having a neutral position where the servo valve effects no change in cylinder pressure wherein any movement of the cam follower from the neutral position effects corresponding changes in cylinder pressure to return the cam follower toward neutral position, the stop members being arranged to uniformly contact all the cam followers when the ram is near its press closed position and is parallel to the bed, and to preferentially contact the servo valve cam followers when the ram is not parallel to the bed to change the pressure in at least one cylinder to return the ram to parallel attitude, drive means connected to the movable part of each pair for synchronously changing the relative positions of the servo valves and the stop members whereby the servo valves control the cylinders to move the ram sufficiently to restore the relative position of the servo valves and the stop members, and control means for energizing the drive means for controlling the velocity and position of the ram according to a preset scheme.

2. A hydraulic control for a compression molding press, the press having a bed, a ram, and a plurality of hydraulic cylinders positioned on the ram to provide the main press force for urging the ram toward the bed, including hydromechanical servo valves movably mounted on the ram and each hydraulically coupled with an adjacent cylinder to control the cylinder pressure, each servo valve including a cam follower having a neutral position where the servo valve effects no change in cylinder pressure wherein any movement of the cam follower from the neutral position effects corresponding changes in cylinder pressure to return the cam follower toward neutral position, stop surfaces accurately positioned relative to the bed and arranged to uniformly contact all the servo valve cam followers when the ram is near its press closed position and is parallel to the bed, and to preferentially contact the servo valve cam followers when the ram is not parallel to the bed to change the pressure in at least one cylinder to return the ram to parallel attitude, drive means connected to each servo valve for synchronously moving the servo valves relative to the stop surfaces whereby the servo valves control the cylinders to move the ram sufficiently to restore the relative position of the servo valves and the stop surfaces, means for sensing the operation of the drive means and producing an output signal representing the ram movement, and control means including a feedback loop responsive to the output signal for energizing the drive means for controlling the velocity and position of the ram according to a preset scheme.

3. A hydraulic control for a compression molding press, the press having a bed, a ram, and a plurality of hydraulic cylinders positioned on the ram to provide the main press force for urging the ram toward the bed, the plurality of cylinders comprising a group of outer cylinders located near the periphery of the ram and inner cylinder means centrally located on the ram, the cylinder means comprising at least one hydraulic cylinder, including an averaging valve means having input means connected to the outer cylinders to produce an output pressure respresenting the average of the outer cylinder pressures, and means for supplying the average pressure to the said inner cylinder means whereby bending stresses in the ram are minimized, a plurality of position transducers each having a pair of separate parts mounted on supports respectively comprising the ram and the bed, the parts of each pair being aligned to contact each other upon press closing, means for movably mounting one part of each pair on its support for adjustment of its position relative to its complementing part, the parts of each pair consisting of a hydromechanical servo valve including a cam follower and a stop member including a cam surface for contacting the cam follower, the hydromechanical servo valves each hydraulically coupled with an adjacent one of said outer cylinders to control the cylinder pressure, the cam follower of each servo valve having a neutral position where the servo valve effects no change in the respective cylinder pressure wherein any movement of the cam follower from the neutral position effects corresponding changes in the respective cylinder pressure to return the cam follower toward neutral position, the stop members being arranged to uniformly contact all the cam followers when the ram is near its press closed position and is parallel to the bed, and to preferentially contact the servo valve cam followers when the ram is not parallel to the bed to change the pressure in at least one cylinder to return the ram to parallel attitude, drive means connected to the movable part of each pair for synchronously changing the relative positions of the servo valves and the stop members whereby the servo valves control the cylinders to move the ram sufficiently to restore the relative position of the servo valves and the stop members, and control means for energizing the drive means for controlling the velocity and position of the ram according to a preset scheme.

4. A hydraulic control for a compression molding press, the press having a bed, a ram, and a plurality of hydraulic cylinders positioned on the ram to provide the main press force for urging the ram toward the bed, including a plurality of position transducers each having a pair of separate parts mounted on supports respectively comprising the ram and the bed, the parts of each pair being aligned to contact each other upon press closing, means for movably mounting one part of each pair on its support for adjustment of its position relative to its complementing part, the parts of each pair consisting of a hydromechanical servo valve including a cam follower and a stop member including a cam surface for contacting the cam follower, the hydromechanical servo valves each hydraulically coupled with an adjacent one of said cylinders to control the cylinder pressure, the cam follower of each servo valve having a neutral position where the servo valve effects no change in cylinder pressure wherein any movement of the cam follower from the neutral position effects corresponding changes in cylinder pressure to return the cam follower toward neutral position, the stop members being arranged to uniformly contact all the cam followers when the ram is near its press closed position and is parallel to the bed, and to preferentially contact the servo valve cam followers when the ram is not parallel to the bed to change the pressure in at least one cylinder to return the ram to parallel attitude, drive means having a single hydraulic motor connected to the movable parts of the pairs for synchronously changing the relative positions of the servo valves and the stop members whereby the servo valves control the cylinders to move the ram sufficiently to restore the relative position of the servo valves and the stop members, control means for energizing the drive means including a controller programmed to control the velocity and position of the ram according to a preset scheme and a valve responsive to the controller for metering fluid to the hydraulic motor for accurately operating the drive means, averaging valve means connected to the cylinders for producing an average pressure representing the average of the cylinder pressures, hydraulic means for establishing a preset reference pressure representing a desired maximum press force, and comparator means connected between the valve and the hydraulic motor having as inputs the average pressure and the reference pressure for overriding the control means when the average pressure closely approaches the reference pressure to prevent the press force from exceeding the desired maximum force irrespective of the control scheme.

* * * * *